United States Patent [19]

Takazawa

[11] 4,277,865

[45] Jul. 14, 1981

[54] CURTAIN HANGER

[76] Inventor: Ietsugu Takazawa,
Bancho-Chidorigafuchi Habitation
901.3 Sanbancho, Tokyo, Japan

[21] Appl. No.: 47,721

[22] Filed: Jun. 12, 1979

[30] Foreign Application Priority Data

Jun. 14, 1978 [JP] Japan ..... 53-81616
Sep. 11, 1978 [JP] Japan ..... 53-124691

[51] Int. Cl.[3] ..... A44G 21/00

[52] U.S. Cl. ..... 24/345; 160/348; 24/369

[58] Field of Search ..... 24/84 R, 84 A, 73 CA; 160/348; 248/327, 333, 318

[56] References Cited

U.S. PATENT DOCUMENTS

| | | | |
|---|---|---|---|
| 2,658,556 | 11/1953 | Fleisher | 248/327 X |
| 2,901,795 | 9/1959 | Graber | 24/84 R |
| 2,996,117 | 8/1961 | Roberts | 160/348 |
| 3,114,186 | 12/1963 | Olsen | 24/84 R |
| 3,399,712 | 9/1968 | Weisberg | 24/84 R X |
| 4,047,687 | 9/1977 | Turner | 248/318 |
| 4,166,308 | 9/1979 | Schmitz et al. | 24/84 R |
| 4,170,053 | 10/1979 | Rosenzweig | 24/84 R |

*Primary Examiner*—Roy D. Frazier
*Assistant Examiner*—Peter A. Aschenbrenner
*Attorney, Agent, or Firm*—Holman & Stern

[57] ABSTRACT

An adjustable curtain hanger which is fitted to the upper edge of a curtain and is hung on a curtain runner to suspend the curtain and having an adjustable connection between the hook and curtain engaging part which facilitates adjusting the height of the curtain with respect to the floor.

4 Claims, 19 Drawing Figures

CURTAIN HANGER

BRIEF SUMMARY OF THE INVENTION

This invention relates to a curtain hanger which is fitted to the upper edge of a curtain and is hung on a curtain runner so as to be used to suspend the curtain.

In a conventional curtain hanger of this kind, a holding rod to hold a curtain and a hanging hook to be hung on a curtain runner are integrally formed and can not be moved relatively with each other, therefore the curtain and curtain runner are fixed in the relative positions and the curtain can not be moved up and down to freely adjust the clearance between the lower edge of the curtain and the surface of a floor.

Therefore, an object of the present invention is to provide a curtain hanger wherein such defects of the conventional curtain hanger of this kind are eliminated and the curtain can be freely and easily moved up and down to adjust the curtain suspending position.

BRIEF DESCRIPTION OF THE SEVERAL VIEWS OF THE DRAWINGS

The drawings show embodiments of the present invention.

DETAILED DESCRIPTION

Figure 1:
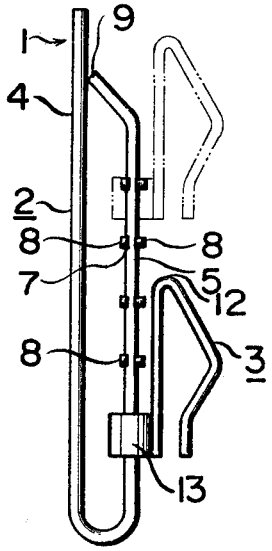
FIG. 1 is an elevation of an embodiment.

Embodiments of the present invention shall be described with reference to the drawings.

In the drawings, a curtain hanger (1) is shown and comprises a fitting part (2) to be fitted to the upper edge of a curtain and a hanging hook (3) movable up and down relatively to this fitting part (2) and engageable with a hanging ring of a curtain runner.

Figure 2:
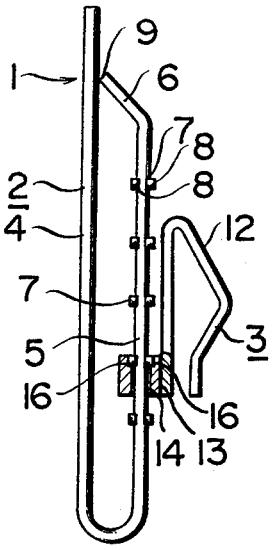
FIG. 2 is an elevation with a fitting cylinder of a hanging hook vertically sectioned.
Figure 5:
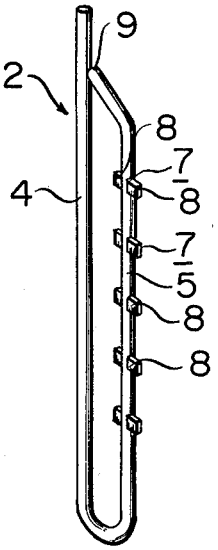
FIG. 5 is a perspective view of a fitting part.
Figure 8:
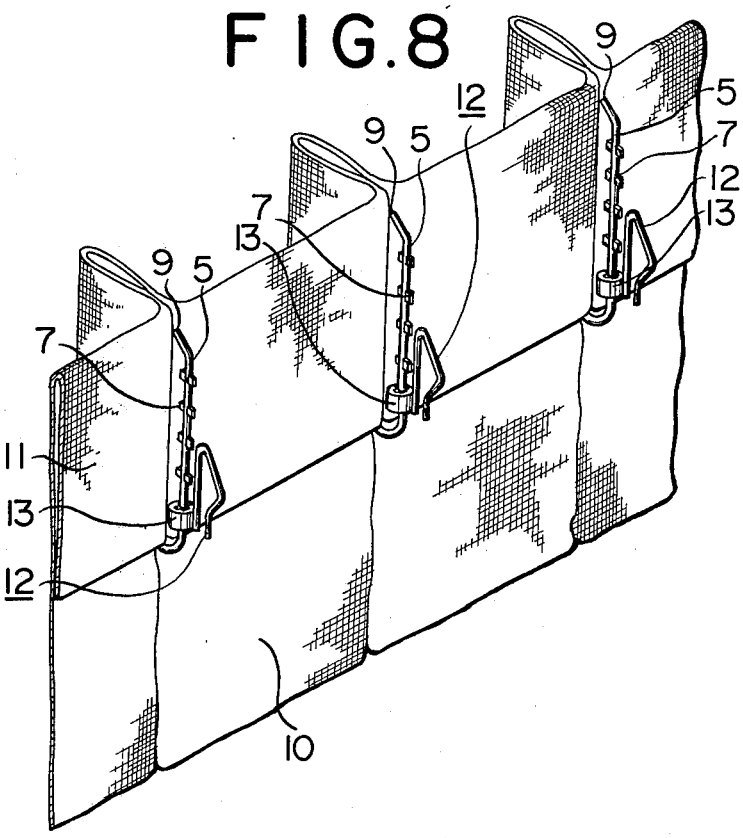
FIG. 8 is a perspective view showing the curtain hangers as fitted to a curtain.
Figure 9:
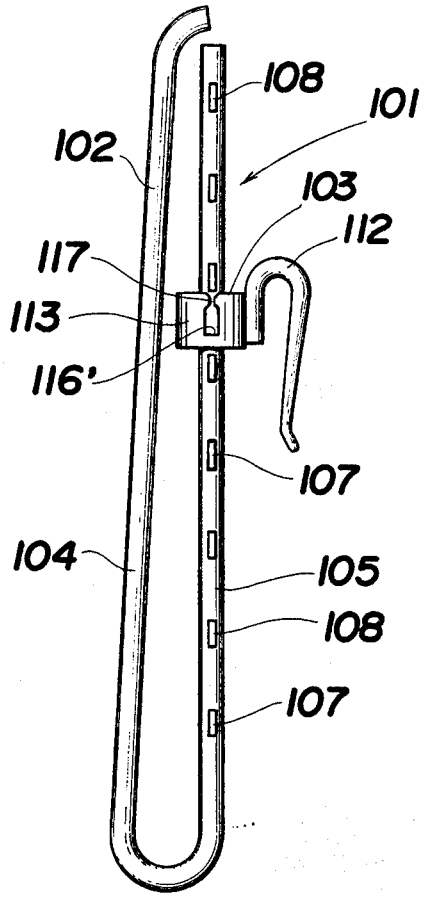
FIG. 9 is a side view of another embodiment.

As well shown in FIGS. 2 and 5 the fitting part (2) is made of a metal, synthetic resin or elastic rod material bent substantially in the middle. One half of the fitting part (2) forms an inserted rod (4) extending straight vertically upward to be inserted into the upper edge of a curtain and the other half consists of an adjusting rod (5) extending upward in parallel with the inserted rod (4) and a holding rod (6) continued upward of the adjusting rod (5) as bent tword the inserted rod (4). A plurality of locking means (7) are provided at vertical intervals on the adjusting rod (5) and each consists of locking projections (8) projecting in directions opposed to each other. The end (9) of the holding rod (6) is adjacent to the side of the inserted rod (4) so that a curtain (10) may be held in the upper edge (11) as shown in FIG. 8 between the end (9) and the side of the inserted rod (4).

Figure 3:
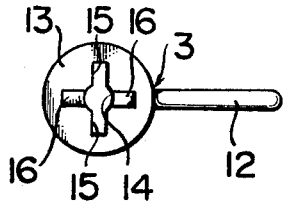
FIG. 3 is a plan view of a hanging hook.
Figure 4:
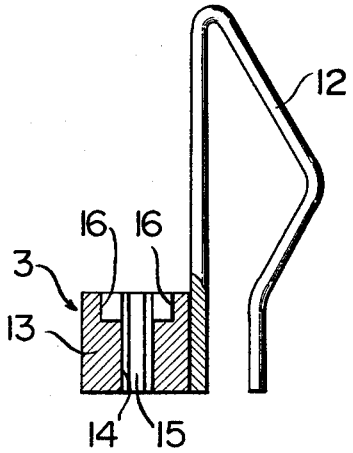
FIG. 4 is an elevation of the hanging hook with the fitting cylinder vertically sectioned.

As well shown in FIGS. 3 and 4, the hanging hook (3) consists of a hook (12) formed of the rod material bent downward substantially in the middle and a fitting cylinder (13) to be fitted to the adjusting rod (5) of the fitting part (2).

As well shown in FIGS. 3 and 4, a through hole (14) is made in the center of the fitting cylinder (13) and two passing grooves (15) are made in positions opposed to each other along this through hole (14) so that, when the fitting cylinder (13) is fitted to the adjusting rod (5) of the fitting part (2), the projections (8) of the adjusting rod may pass respectively through the passing grooves (15). Engaging recesses (16) are provided as opposed to each other in the direction intersecting at right angles with the passing grooves (15) in the upper part of the fitting cylinder (13) so that, when the hanging hook (3) is hung on a curtain runner, as shown in FIG. 1, the projections (8) of the adjusting rod (5) may engage respectively with the engaging recesses (16) and the fitting cylinder (13) and adjusting rod (5) may be prevented from rotating relatively.

Figure 6:
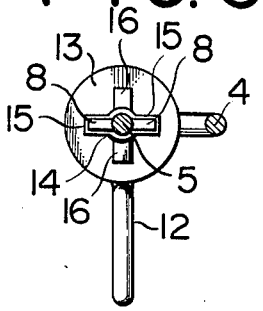
FIG. 6 is a partly sectioned plan view showing passing grooves and projections as coinciding respectively with each other.
Figure 7:
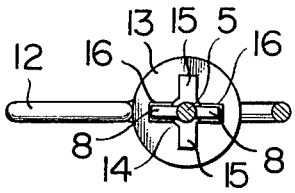
FIG. 7 is a partly sectioned plan view showing the projections of the fitting part as fitted respectively in engaging recessed grooves of the hanging hook.

Therefore, when the fitting cylinder (13) is positioned between the two adjacent upper and lower projections (8) of the adjusting rod (5) and, as shown in FIG. 6, the projections (8) and passing grooves (15) are made to respectively coincide with each other while rotating the fitting cylinder (13) with respect to the adjusting rod (5), the projections (8) will pass respectively through the passing grooves (15) and thus the hanging hook (3) will be able to be moved up and down with respect to the fitting part (2). When the position of the hanging hook (3) with respect to the fitting part (2) is adjusted, the fitting cylinder (13) is rotated by (90) degrees with respect to the adjusting rod (5), as shown in FIG. 7, the engaging recesses (16) are made to coincide respectively with the projections (8) of the adjusting rod (5) and the projections (8) are engaged respectively with the engaging recesses (16). When the hook (12) is hung on the curtain runner, a force will be downwardly applied to the fitting part (2) by the weight of a curtain (10) and, as the hanging hook (3) is hung on the curtain runner, the projections (8) of the adjusting rod (5) will be engaged respectively with the engaging recesses (16) in the upper part of the fitting cylinder (13) of the hanging hook (3) and the fitting cylinder (13) will be prevented from rotating and will be fixed.

Another embodiment is shown in FIGS. 9 to 19. The same as in the above described embodiment, this curtain hanger (101) consists of a fitting part (102) and a hanging hook (103) movable up and down with respect to this fitting part (102).

Figure 10:
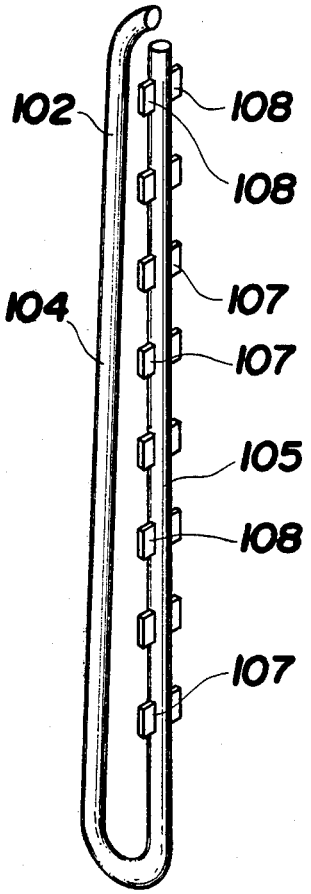
FIG. 10 is a perspective view of a fitting part of the embodiment of FIG. 9.

As shown in FIG. 10, the fitting part (102) is formed of an elastic rod material as bent upward substantially in the middle and consists of an inserted rod (104) which is one half of the fitting part and is to be inserted into the upper edge of a curtain and an adjusting rod (105) which is the other half. A plurality of locking means (107) are provided at vertical intervals on this adjusting rod (105) and each consists of projections (108) provided to project as opposed to each other.

Figure 11:
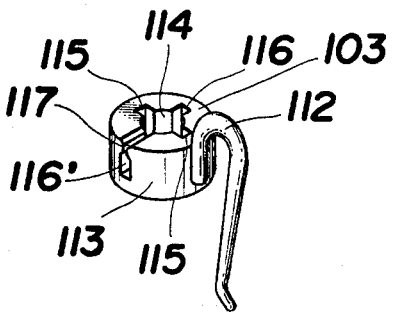
FIG. 11 is a perspective view of a hanging hook of the embodiment of FIG. 9.
Figure 12:
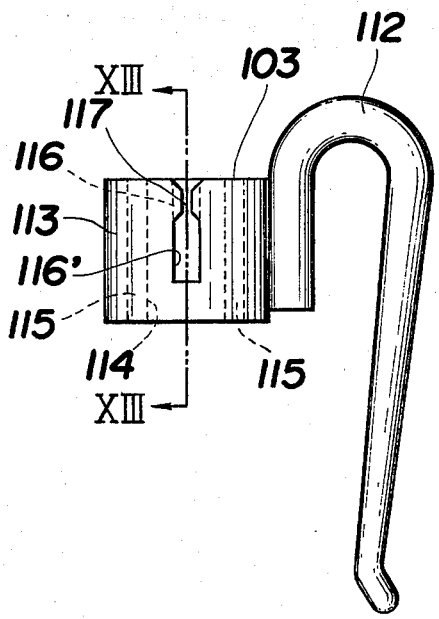
FIG. 12 is a side view of the hanging hook of FIG. 11.
Figure 13:
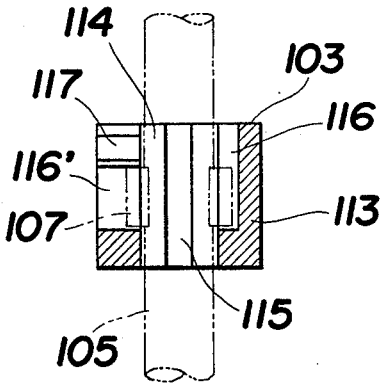
FIG. 13 is a vertical section taken on line XIII—XIII in FIG. 12.
Figure 14:
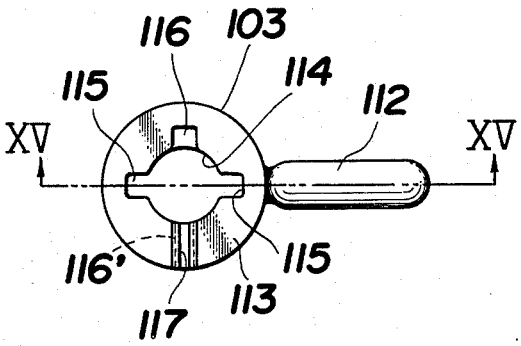
FIG. 14 is a plan view of the hanging hook of FIG. 12.
Figure 15:
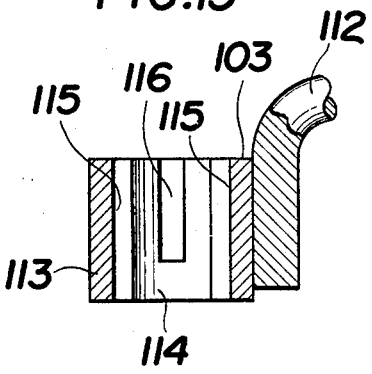
FIG. 15 is a vertical section view taken on line XV—XV in FIG. 14.
Figure 16:
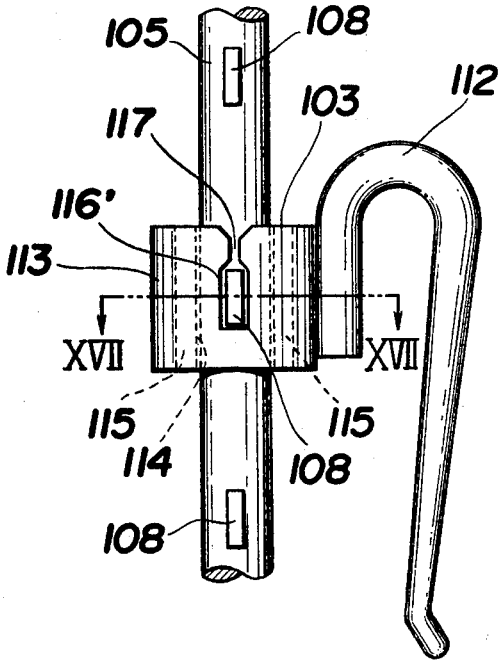
FIG. 16 is a partial side view showing an adjusting rod and an engaging cylinder shaft of the hanging hook as engaged with each other.

As shown in FIGS. 11 and 12, the hanging hook (103) consists of a downwardly bent hook (112) a fitting and cylinder (113) made of such elastic material as a synthetic resin and secured to one end part of the hook (112). As well shown in FIGS. 12 to 15, this fitting cylinder (113) consists of a through hole (114) made in the axial direction in the center, passing grooves (115) made in positions opposed to each other along this through hole (114) and engaging grooves (116) and (116') provided along the through hole (114) so as to be opposed to each other in the direction at right angles with these passing grooves (115). These engaging grooves (116) and (116') end on the way within the fitting cylinder (113). One engaging groove (116') comes to the outer surface of the fitting cylinder (113) and a narrowed part (117) is formed in the upper part of the cylinder (113).

Figure 18:
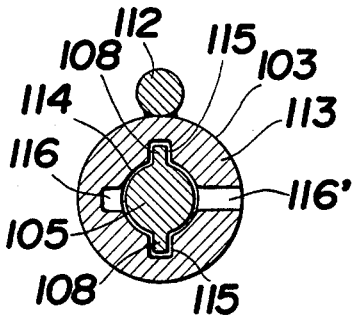
FIG. 18 is a cross-sectional view similar to FIG. 17 but showing projections of the adjusting rod and passing grooves of the hanging hook as made to coincide respectively with each other.

Therefore, when the fitting cylinder (113) is positioned between the adjacent projections (108) of the adjusting rod (105) and, as shown in FIG. 18, the passing grooves (115) are made to coincide respectively with the projections (108) while rotating the fitted cylinder (113) with respect to the adjusting rod (105), the projections (108) will be able to pass respectively through the passing grooves (115) and thus the hanging hook (103) will be able to be moved up and down relatively with the fitting part (102).

Figure 17:
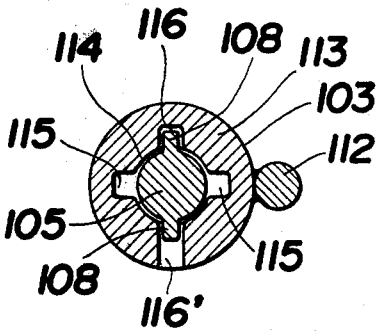
FIG. 17 is a horizontally sectioned plan view taken on line XVII—XVII in FIG. 16.

When the hanging hook (103) is thus adjusted in the position with respect to the fitting part (102), the fitting cylinder (113) is rotated by 90 degrees with respect to the adjusting rod (105), as shown in FIG. 17, the engaging grooves (116) and (116') are made to coincide respectively with the projections (108) and the projections (108) are engaged respectively with both engaging grooves (116) and (116') while expanding the narrowed part (117) of one engaging groove (116'), the hanging hook (103) will be prevented by the engaging grooves (117) from rotating with respect to the adjusting rod and also by the narrowed part (117) of one engaging groove (116') from moving up and down.

Figure 19:
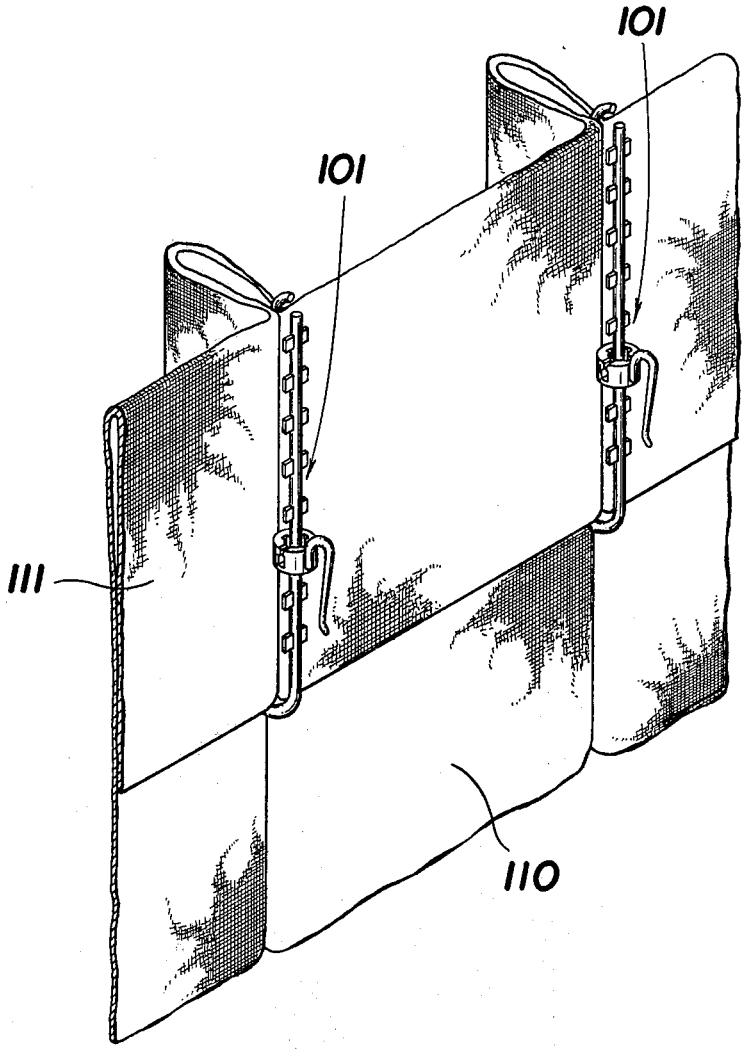
FIG. 19 is a perspective view showing the curtain hangers as fixed to a curtain.

When the curtain hangers (101) are thus fitted to the upper edge (111) of a curtain (110) as shown in FIG. 19, without removing and working the curtain (110) itself, the hanging hook (103) will be able to be moved up and down with respect to the fitting part (102) and the curtain (110) hanging position in the vertical direction will be able to be freely selected.

I claim:

1. An adjustable curtain hanger comprising a fitting part adapted to be fitted to the upper edge of a curtain, an adjusting rod attached to said fitting part in a manner to extend substantially vertically when in use, a plurality of locking projections in longitudinal spaced relationship on said adjusting rod, a hook member having a fitting cylinder attached thereto which cooperatively engages with said adjusting rod to adjustably suspend a curtain, said fitting cylinder being a cylindrical member having a hole therethrough which slidably and rotatably receives said adjusting rod therein, the central axis of said hole being substantially parallel to the cylindrical axis of said fitting cylinder, means on said cylindrical member to allow said locking projections to pass therethrough when said cylindrical member is rotated into the adjusting position, and locking means on said cylindrical member adapted to engage said projections and support said fitting part when said cylindrical member is rotated into the locking position.

2. A curtain hanger as claimed in claim 1 wherein said means to allow said locking projections to pass through said cylindrical member comprises at least one slot extending radially from and the full length of said hole and having a size to allow said projections to freely pass therethrough.

3. A curtain hanger as claimed in claim 2 wherein said locking projections comprise short rod-like members extending transversely to said adjusting rod so that they are substantially horizontal in use, and said locking means comprises at least one locking slot extending from the top end of said fitting cylinder partly the full length of and radially from said hole, said locking slot being angularly displaced with respect to the first mentioned slot, and having a width to receive said projections therein.

4. A curtain hanger as claimed in claim 3 wherein a retaining means is provided in said locking slot, said retaining means compris narrowed part of said locking slot at the upper end thereof to releasably retain one of said projections therein, said fitting cylinder being made of a material having sufficient resiliency to allow said retained projection to be pushed through said narrowed part by finger pressure.

* * * * *